US005993562A

United States Patent [19]

Roelofs et al.

[11] Patent Number: 5,993,562

[45] Date of Patent: Nov. 30, 1999

[54] METHOD, COMPOSITION, AND KIT FOR ABRASIVE CLEANING OF FLUID DELIVERY SYSTEMS

[75] Inventors: Robert R. Roelofs, Allen Park; Jonathan N. Warren, Dearborn; Robert N. Deneau, Lake Orion, all of Mich.

[73] Assignee: PPG Industries Ohio, Inc., Cleveland, Ohio

[21] Appl. No.: 09/080,482

[22] Filed: May 18, 1998

Related U.S. Application Data

[62] Division of application No. 08/689,751, Aug. 13, 1996, abandoned.

[51] Int. Cl.[6] ..... B08B 7/00; B08B 9/00

[52] U.S. Cl. ..... 134/7; 134/8; 134/38; 134/22.13; 134/22.14; 134/22.16; 134/22.17; 134/22.19

[58] Field of Search ..... 134/7, 8, 38, 22.13, 134/22.14, 22.16, 22.17, 22.19

[56] References Cited

U.S. PATENT DOCUMENTS

| | | | |
|---|---|---|---|
| 3,865,756 | 2/1975 | Smith | 252/529 |
| 4,153,545 | 5/1979 | Zwack et al. | 210/23 F |
| 4,242,468 | 12/1980 | Baack et al. | 521/170 |
| 4,374,443 | 2/1983 | Mosell | 15/3 |
| 4,699,730 | 10/1987 | Miles et al. | 252/181 |
| 4,801,333 | 1/1989 | Mosell | 134/7 |
| 4,933,056 | 6/1990 | Corrigan et al. | 204/181.7 |
| 4,968,447 | 11/1990 | Dixon et al. | 252/174 |
| 4,997,882 | 3/1991 | Martz et al. | 525/65 |
| 5,141,562 | 8/1992 | Cells | 106/310 |
| 5,154,764 | 10/1992 | Cells et al. | 106/310 |
| 5,156,674 | 10/1992 | Cells | 106/20 |
| 5,269,820 | 12/1993 | Fuji et al. | 51/293 |
| 5,298,181 | 3/1994 | Choy et al. | 252/95 |
| 5,308,403 | 5/1994 | Yam et al. | 134/7 |
| 5,316,587 | 5/1994 | Yam et al. | 134/7 |
| 5,319,032 | 6/1994 | Martz et al. | 525/301 |
| 5,322,532 | 6/1994 | Kurtz | 51/293 |
| 5,397,602 | 3/1995 | Martz et al. | 427/343.5 |
| 5,397,646 | 3/1995 | Nickle et al. | 428/423.1 |
| 5,416,168 | 5/1995 | Willis et al. | 525/333.2 |
| 5,427,856 | 6/1995 | Laura et al. | 428/413 |
| 5,443,748 | 8/1995 | Bergishagen et al. | 252/162 |
| 5,466,752 | 11/1995 | Barsotti et al. | 525/65 |
| 5,486,570 | 1/1996 | St. Clair | 525/123 |
| 5,503,778 | 4/1996 | Liu et al. | 252/542 |
| 5,505,800 | 4/1996 | Harries et al. | 149/46 |
| 5,575,705 | 11/1996 | Yam et al. | 451/39 |

FOREIGN PATENT DOCUMENTS

| | | |
|---|---|---|
| 0193375 | 9/1986 | European Pat. Off. . |
| 0334566 | 9/1989 | European Pat. Off. . |
| 0 601 665 | 6/1994 | European Pat. Off. . |
| 0702711 | 3/1997 | European Pat. Off. . |
| 4319287 | 12/1994 | Germany . |
| 1041779 | 9/1966 | United Kingdom . |
| 2140337A | 11/1984 | United Kingdom . |
| 2173102A | 10/1986 | United Kingdom . |
| 2260483A | 4/1993 | United Kingdom . |
| WO85/03511 | 8/1985 | WIPO . |
| WO91/08282 | 6/1991 | WIPO . |
| WO97/04889 | 2/1997 | WIPO . |
| WO98/06802 | 2/1998 | WIPO . |

*Primary Examiner*—Randy Gulakowski
*Assistant Examiner*—Zeinab El-Arini
*Attorney, Agent, or Firm*—Kenneth J. Stachel; Ann Marie Cannoni

[57] ABSTRACT

A method of cleaning interior surfaces of fluid delivery systems including (a) passing through the system an abrasive cleaner composition including at least one liquid carrier containing solubilizable abrasive particles, at least some of which are in non-solubilized form, effective to abrade the material to be removed from the interior surfaces, and (b) rinsing the system with at least one fluid effective to (i) displace the carrier and (ii) remove the abrasive particles, at least partially by such chemical means as dissolution or decomposition or neutralization. Optionally, the method can include a first step of contacting the inside surfaces of the fluid delivery system with a pretreatment fluid capable of softening or loosening the material that is to be cleaned from the internal surfaces of the delivery system for a time sufficient to soften or loosen unwanted material. A cleaning kit including the abrasive cleaner and rinsing fluid is also provided.

24 Claims, No Drawings

METHOD, COMPOSITION, AND KIT FOR ABRASIVE CLEANING OF FLUID DELIVERY SYSTEMS

This is a divisional of U.S. patent application Ser. No. 08/689,751, filed Aug. 13, 1996 now abandoned.

BACKGROUND OF THE INVENTION

This invention relates to compositions and methods for removing unwanted deposits or build-up on surfaces of fluid delivery system and particularly for cleaning enclosed fluid delivery systems.

Large quantities of fluids with suspended, dispersed or dissolved materials (hereinafter referred to as "Carried Materials") are circulated through fluid delivery systems and over time the material may deposit or settle on various interior surfaces of the fluid delivery system. For example, paint is circulated and usually recirculated in piping of paint delivery systems for painting automobiles in automobile manufacturing plants. During the course of normal operation, the Carried Materials of a fluid may build up or deposit on the inside of paint fluid delivery systems, especially in areas of reduced flow such as in filters, tees, elbows and valves. This is especially true for ultrafilter membrane filters used in the electrocoat coating or painting systems. As a consequence fluid delivery systems are cleaned on a periodic basis to remove the unwanted Carried Materials adhering to the insides of pipes, tubing, filters and/or valves.

When the fluid delivery systems are cleaned, it may be necessary to remove all residual Carried Materials to avoid the rapid fouling of the system which can occur if the residual Carried Materials are available for contamination. In the case of electrocoat ultrafilters, the residual paint can plug the pores of the membrane and prevent the filter from removing contaminants from the circulated electrocoat paint. Since these systems are enclosed, removal of unwanted paint adhering to the insides of tubes, pipes and other conduits is difficult to achieve because access is difficult, and, in fact, frequently it is difficult even to determine the extent of cleaning.

A major problem that is encountered in cleaning paint fluid delivery systems is the complete removal of the cleaning materials from the system after the cleaning materials have completed their task. The art teaches the use of abrasive materials such as sand, mica and polymeric particulates. The art also teaches the use of insoluble nonabrasive materials such as "sponge-balls". However, if these materials are not completely removed from the system, they become contaminants in the paint system. These cleaning materials can be subsequently carried through the piping by the paint to the paint applicator and deposited on the object or ware to be painted along with the paint forming paint defects commonly referred to as "dirt in the paint". In other words, the cleaning materials can cause the same problems as the unwanted paint deposited on the inside of the piping of the system.

Conventionally, enclosed cathodic electrocoat paint systems are cleaned by circulation of known cleaning agents such as water, other solvents, surfactants, and organic acids, while enclosed anionic electrocoat systems are cleaned by circulating water, other solvents, surfactants, and acceptable sources of alkalinity such as sodium hydroxide and/or various amines. Circulation and recirculation in either case may take place under pressure and may be conducted for up to 48 hours or more. However, these methods often fail to remove all of the deposited paint materials in the system.

Frequently, electrocoat paint systems include membrane filters or ultrafilters whose purpose is to remove low molecular weight contaminants and impurities. These may have found their way into the paint or the system from a previous treatment step for the ware, particularly metal pretreatment chemicals such as chromates, phosphates, and other compounds such as chlorides and sulfates; such water soluble salts are removed by the ultrafilters together with water. The ultrafilters are usually tubular or spiral wound in design, and paint and other residue or Carried Materials can become coated on the inside surface of the membranes causing the ultrafilters to lose efficiency or become so clogged that the filters stop working altogether.

The electrocoat ultrafilters must be cleaned along with the rest of the system and are generally subjected to more or less the same kind of recirculation cleaning, either in place in the system, or after being isolated so the recirculative effect is concentrated on them. In spite of special treatment in many cases, the conventional cleaning compositions frequently do not remove all the paint as well as various contaminants which may be lodged quite tenaciously in the membrane. A good description of membrane filters and their cleaning can be found in U.S. Pat. No. 4,153,545 to Zwack and Christenson. Recirculation of cleaning materials is commonly practiced also in systems not including ultrafilters.

In U.S. Pat. No. 4,968,447, Dixon and Maxwell acknowledge the prior use of cleaning compositions for paint fluid delivery systems including such abrasive particles as sand and mica, which, they note, tend to settle and remain in the system to cause numerous problems; also, being highly abrasive, these materials cause unnecessary wear. In addition, such abrasives present a disposal problem when they are recovered from the system. Dixon and Maxwell go on to propose the use of polymeric particulates made of polypropylene, polyethylene, polyvinylchloride, polytetrafluoroethylene, and various other organic hydrophobic polymers and copolymers. Although these particulates do not settle out readily and can generally be rinsed from the system and incinerated, their removal from the system must still be complete. A procedure must be in place to assure that all the particulates are recovered or they can become contaminants of the system just like the old paint deposits they are trying to remove.

ABCOR Corporation teaches a method of cleaning electrocoat system ultrafilters using insoluble, nonabrasive sponge-balls which can be forced through the system including the microfilters. The purpose of the sponge-balls is to scrub the inner walls of the tubing and filters like a sponge. Of course, the sponge-balls must all be removed from the system to complete the cleaning or the system could become plugged by any remaining sponge-balls.

The rheological additive "Viscotrol", available from Mooney Chemicals, Inc. of Cleveland, Ohio, is, we understand, a particulate derivative of castor oil, apparently lightly crosslinked, which may be added to a recirculating paint cleaning system to act as a mild abrasive. After use, their removal from the system is assured by introducing an alcohol or other solvent which is absorbed by the particles, causing them to swell so they may be readily separated by filtering. "Viscotrol" is referred to as a "rheological material" by Bergishagen et al. in U.S. Pat. No. 5,443,748, which employs it in several examples for cleaning paint delivery systems of a type with which we are concerned.

In spite of the above known compositions and techniques, the cleaning art for fluid delivery systems for fluids with Carried Materials is in need of a better way to remove as completely as possible the deposits and build-up from the tubes, piping, pumps and filters of the fluid delivery systems. It would be desirable to provide cleaning methods and compositions that would completely clean the old deposits and buildup from the inside of such fluid delivery systems and which would remove as completely as possible the cleaning materials from the system so that the cleaning compositions would not become contaminants of the fluid delivery system.

SUMMARY OF THE INVENTION

In accordance with the present invention, there is provided a method of cleaning interior surfaces of fluid delivery systems. The method comprises (a) passing through the system an abrasive cleaner composition comprising at least one liquid carrier containing solubilizable abrasive particles at least some of which are in non-solubilized form effective to abrade the deposited material to be removed from the interior surfaces of the system, and (b) rinsing the system with at least one fluid effective to (i) displace the carrier and (ii) remove the particles, at least partially by such chemical means as dissolution, decomposition or neutralization. Optionally, the method can include a first step of contacting the inside surfaces of the fluid delivery system with a pretreatment fluid composition capable of softening or loosening the deposited material on the interior surfaces of the fluid delivery system for a time sufficient to soften or loosen said material.

Also provided is an abrasive cleaning kit capable of cleaning unwanted deposited materials from interior surfaces of fluid delivery systems. The kit is comprised of: (A) an abrasive cleaner composition comprising a liquid carrier containing solubilizable but having non-solubilized abrasive particles effective to abrade the unwanted material; and (B) at least one rinsing fluid effective to (i) displace said carrier and (ii) remove said abrasive particles at least partially by such chemical means as dissolution, decomposition, and/or neutralization comprising water and at least one material chosen from the group consisting of organic solvents, acids, amines, and mixtures thereof. Optionally, the kit can have (C) a pretreatment fluid composition comprising a liquid capable of softening the unwanted material that is to be cleaned from the interior surfaces of the fluid delivery system.

Another aspect of the present invention includes cleaner compositions comprised of the abrasive cleaner composition (A) and the pretreatment fluid composition of (C) of the above abrasive cleaning kit. Also, the abrasive cleaner composition (A) or the mixture of cleaner composition of (A) and pretreatment fluid of (C) can include one or more surfactants and/or acids or alkali materials.

DETAILED DESCRIPTION OF THE INVENTION

Fluid delivery systems are used in many industrial and commercial applications. A particular example of a fluid delivery system is the paint fluid delivery system, but this invention also may be useful in other types of fluid delivery systems, for example, fluid delivery systems used in the dairy industry.

The abrasive-containing cleaning composition and method of this invention should be useful in removing unwanted deposits from the interior surfaces of fluid delivery systems that handle dairy products, including the ultrafilters that are commonly used in dairy processing systems. A common deposit found in dairy product fluid delivery systems is "milk stone," which is the unwanted deposit on interior surfaces of piping and enclosed fluid dairy systems, and which generally have fat and calcium. The abrasive nature of the cleaning composition of this invention coupled with the ability to completely remove most, if not all, traces of the abrasive particles from the fluid delivery system would prevent contamination of the fluid handled by the fluid delivery system subsequent to the cleaning process. This should solve a longstanding problem of the dairy industry of efficiently and effectively cleaning milk stone deposits from the interior surfaces of fluid delivery systems.

For paint fluid delivery systems, there are generally two basic types, circulating systems, sometimes called recirculating or "recirc" systems, and non-circulating or "dead head" systems. Typically, in circulating fluid delivery systems, the paint or coating is continuously recirculated from the main supply vessel, or tank, through piping or tubing to the coating applicator and then returned to the supply tank through the return line. The fluid is continuously flowing through the lines from the supply tank to the coating applicator and then back to the supply tank. In a "dead head" fluid delivery system, the coating is delivered from the supply vessel through the piping to the coating applicator. The fluid only moves when the coatings applicator is operating, otherwise the fluid remains static in the fluid supply line.

The coatings can be delivered through the fluid delivery systems by the use of pumps, such as positive displacement pumps, piston pumps or turbine pumps. In noncirculating fluid delivery systems, sometimes pressure pots are used instead of a pump. A pressure pot maintains a pressure head of compressed air above the coating in the pot. When coating is used at the applicator, the fluid pressure drops in the supply line and more fluid is pushed into the supply line by the pressure head in the pressure pot, this maintains a constant pressure in the entire paint supply system. Typically, the paint fluid delivery system, includes piping or tubing, filters, valves, gauges, and fluid supply vessels or tanks.

By the term "enclosed paint system", we mean to include any delivery system employing tubes or ducts to deliver fluid with Carried Materials, like paint, including both recirculating systems common in the art and "dead head" systems or portions of systems in which such fluid is delivered or conveyed but not recirculated.

Paint fluid delivery systems are sometimes referred to as topcoat systems or primer systems. However, any type of liquid coating may be found in a paint fluid delivery system. For example, primers, topcoats such as monocoat colorcoats, basecoats, and clearcoats, including both solventborne and waterborne materials, typically are moved through paint fluid delivery systems.

Specialized types of recirculating fluid systems may include circulating systems found in electrodeposition or electrocoat paint systems. Normally, the electrocoat coating is continuously circulated through an ultrafiltration system which generally includes permeable membrane filters because of the need to continuously remove contaminants from the electrocoat bath, particularly metal pretreatment chemicals such as chromates, phosphates, and other compounds such as chlorides and sulfides. These membrane filters may be tubular or spiral wound.

In electrocoat paint system cleaning, microfiltration or ultrafiltration tubes with which we are concerned are also known as membrane filters. They are made of a permeable but strong synthetic resin and may be coated on the inside with a selectively permeable layer or membrane. The permeate passes through the membrane and the walls of the tubes under pressure of the fluid in the tubes. The membranes are designed to filter very small contaminants from water-borne electrocoat paint, most commonly in cathodic and/or anionic electrocoat paint circulating systems.

In the method of this invention of cleaning, the internal surfaces of a fluid delivery system, such as those described above, the step of passing through the system at least one abrasive cleaner or abrasive-containing cleaning composition involves a cleaner having solubilizable abrasive particles at least some of which are in nonsolubilized form in a liquid carrier. The rinsing step of the method involves at least one fluid that is effective in displacing the abrasive cleaner or abrasive-containing cleaning composition and in removing the abrasive particles from the system. The difference between the "abrasive cleaner" and the "abrasive-containing cleaning composition" is that the latter has the abrasive particles with or without the liquid carrier like the "abrasive cleaner" where the pretreatment fluid composition can act as the liquid carrier as more fully discussed infra. Such removal of the abrasive particles in the rinsing step is at least partially by such chemical means as dissolving, decomposing or neutralizing the abrasive particles.

Optionally, the method may additionally include a first step of pretreating by soaking with or circulating through the system a liquid capable of softening or loosening the material to be removed from the fluid delivery system. This liquid will be referred to in this application as a "pretreatment fluid composition", but it should be understood that the pretreatment fluid composition can be circulated through the system as well as be used in a static soak mode.

It is believed, but the invention is not limited by this belief, that the cleaning action of the abrasive cleaner is the result of the contact of the abrasive particles with the unwanted deposits or paint which may have been pre-softened during the optional pretreatment step. If the flow rate of the passing step for the abrasive particles through the fluid delivery system is too gentle then the scrubbing action of the abrasive cleaner may be inadequate. If the flow rate is too high, damage may occur to interior surfaces of valves, gauges or filters of the system. Especially vulnerable are the filter membranes of electrocoat ultra filtration systems. Therefore, the method of the present invention can be and preferably is operated so that the flow of abrasive cleaner or abrasive-containing cleaner composition is under conditions that are similar to what the filter tube manufacturer suggests for circulating paint in ultrafilter systems. For example, ABCOR tubular filter units operate at about 35 to 40 gallons per minute (132 to 151 liters per minute) with an inlet pressure of 70 psi (483 kPa) and an outlet pressure of 10 psi (69 kPa). Another example is the commonly used 8-inch (20 centimeters) (cm) spiral "sanitary design" filter cartridge manufactured by AMT or OSMONICS that can be operated at about 60 to 70 gallons per minute (227 to 265 liters per minute) with 55 psi (379 kPa) inlet pressure and 25 psi (172 kPa) outlet pressure. Of course, the inlet and outlet pressures reflect the flow rate which can vary significantly from system to system. The AMT spiral "regular" operates at a recommended flow rate of about 120 gallons per minute (454 liters per minute). Typically, flow rates in nonelectrocoat paint fluid delivery systems will range from about 4 to 50 gallons per minute (15 to 190 liters per minute).

Also, the flow of the abrasive cleaner or abrasive-containing cleaner composition should be sufficient to inhibit the settling of abrasive particles and to assure at least some turbulence to cause the particles to rub against the internal surfaces of the fluid delivery system. Generally, any flow rate between one-half the recommended flow rate and twice the recommended flow rate of the system will be satisfactory; preferably from about 1 to 1.5 times the normal paint application flow rate. The passing step to abrade the paint deposits may be continued for as long as it takes to remove the unwanted paint deposits. Generally, times greater than 72 hours are normally not needed but may be used. Typically, times range from about 4 to 36 hours. However, in some laboratory testing, complete removal of the unwanted deposited paint was accomplished in as little as 5 minutes (see Examples VII and VIII below).

The abrasive cleaner and abrasive-containing cleaning composition of the present invention contains solubilizable abrasive particles. By "solubilizable" it is meant that the abrasive particles are capable of being dissolved, decomposed or neutralized in the rinsing fluid preferably for their complete removal from the enclosed fluid delivery system. The abrasive particles do not have to be soluble in the aqueous or nonaqueous carrier material of the abrasive cleaner or abrasive-containing liquid cleaning composition. Preferably, the abrasive particles are not or are of limited solubility in the liquid carrier of the abrasive cleaner. If the abrasive particles are soluble in the liquid carrier, the abrasive cleaner can be a super-saturated solution of the particles in the carrier so that solid particles are available for contacting the deposits in the fluid delivery system. Of course, such a super-saturated solution needs to be pumpable through the fluid delivery system.

The abrasive particle should be effective in abrading the material that is to be removed, most often deposited paint materials such as encrustation of dried resinous materials or pigments or a combination of both. Suitable solubilizable abrasive particles may include but are not limited to sodium bicarbonate, boric acid, potassium fluorotitanate, calcium citrate, calcium borate, zinc borate, calcium succinate, calcium pyrophosphate, calcium phosphate, and starch. For paint fluid delivery systems, sodium bicarbonate, boric acid, zinc borate and potassium fluorotitanate are preferred.

Generally, the unagglomerated particle size of the abrasive particles is not critical and may range from about $5\mu$ to $1000\mu$, preferably from about $5\mu$ to $500\mu$. Some of the abrasive particles can agglomerate to form larger aggregates, but this is not preferred. The particular selection of particle size can vary depending on the characteristics of the individual fluid delivery systems. Generally, smaller particles can be easier to keep in suspension in the cleaner compositions. It should be noted, however, that when cleaning spiral wound ultrafilters used in some electrocoat systems, the size of the abrasive particles should not exceed the spacing between the windings of the filter to prevent clogging of the filter with large abrasive particles.

The abrasive cleaning composition also contains an aqueous or nonaqueous liquid carrier for the abrasive particles. The carrier can contain a mixture of one or more organic solvents, water and/or surfactants that aid in softening and dissolving the materials that are to be removed from the fluid delivery system. Suitable organic solvents may include aliphatic solvents such as hexane, heptane, naptha, and mineral spirits; aromatic solvents such as toluene, xylene, SOLVESSO 100, and SOLVESSO 150 (both are aromatic hydrocarbon solvents commercially available from Chemcentral Corp.); alcohols such as ethyl, methyl, n-propyl, isopropyl, n-butyl, isobutyl and amyl alcohol, m-pyrol, and 2-amino-2-methyl-1-propanol; esters such as ethyl acetate, n-butyl acetate, isobutyl acetate, isobutyl isobutyrate, butyl lactate, and oxohexyl acetate; ketones such as acetone, methyl ethyl ketone, methyl isobutyl ketone, diisobutyl ketone, methyl n-amyl ketone, and isophorone. Additional solvents include glycol ethers and glycol ether esters such as ethylene glycol monobutyl ether, diethylene glycol monobutyl ether, ethylene glycol monohexyl ether, propylene glycol monomethyl ether, propylene glycol monopropyl ether, ethylene glycol monobutyl ether acetate, propylene glycol monomethyl ether acetate, and dipropylene glycol monomethyl ether acetate. Also useful are aliphatic dibasic esters such as DBE-3 from DuPont. A type of solvent for the liquid carrier particularly useful in cleaning electrocoat ultrafilter systems is N-alkyl-pyrrolidone wherein the alkyl group contains from 1 to 12 carbon atoms, such as N-methyl-2-pyrrolidone and N-octyl-2-pyrrolidone.

As mentioned above, the cleaning method of this invention can optionally include a first step of contacting the inside surfaces of the fluid delivery system with a pretreatment fluid composition, also referred to as pretreatment fluid, capable of softening or loosening the deposits that are to be cleaned from the internal surfaces of the delivery system for a time sufficient to soften or loosen such deposits. It should be noted that the pretreatment fluid may serve as the carrier for the solubilizable, but preferably substantially non-solubilized or unsolubilized, abrasive particles of the abrasive cleaner to form an "abrasive-containing cleaning composition" of this invention. In this embodiment, the pretreatment fluid is first used to soften the deposited material to be removed from the fluid delivery system, then solubilizable abrasive particles are added to the pretreatment fluid to be circulated in the passing step as is the abrasive cleaner. Usually, the flow rate of the pretreatment step is from about 0.5 to 1.5 times the normal recommended flow rates for the fluid delivery systems, as mentioned above.

The pretreatment fluid can be a mixture of one or more organic solvents and/or water, surfactants, and optionally other materials such as acids or alkali materials. Organic solvents, surfactants, acids, and alkali materials that are suitable for the abrasive cleaner composition are also suitable for the pretreatment fluid. This is particularly suitable where the abrasive particles are added to the pretreatment fluid to form the abrasive-containing cleaner composition. The pretreatment fluid may be used at ambient temperature, preferably at about 74° F. 23° C.), but it may be heated up to about 130° F. (55° C.) to increase its effectiveness.

The purpose of circulating and/or exposing the fluid delivery system to a pretreatment fluid is to chemically remove as much of the deposits or unwanted material as possible and sufficiently soften any remaining deposits, like paint, to aid in the removal of these residual deposits with the abrasive cleaner composition or the abrasive-containing cleaning composition, which preferably follows as a separate step. In order to achieve maximum cleaning, it has been found that no more than 24 hours exposure to the pretreatment fluid is normally required, although longer soak times may be employed when needed.

It has been noted that different amounts of deposits or residual paint can build up inside of filter tubes taken from different positions in the same electrocoat system filter bank. This is likely to happen because the concentration of the paint changes as it moves toward the end of the filtering system. Desirable pretreatment cleaning times can differ depending on the degree of buildup in the filters' interior. In electrocoat systems, pretreatment times may vary, depending on the severity of this problem, from about 4 to 24 hours.

After the abrasive particles are passed through the fluid delivery system to remove the deposits, a rinse step is performed in the fluid delivery system cleaning process of this invention for preferably complete removal of the abrasive particles from the fluid delivery system. Normally, rinsing the system with a fluid simply to displace the abrasive cleaner composition may not be sufficient to completely remove all of the abrasive particles from the system. As mentioned above, if the abrasive particles are not completely removed from the fluid delivery system, the abrasive particles themselves become contaminants in the system. To accomplish complete removal of the abrasive particles, the rinsing fluid is a fluid composition that results in the dissolution, decomposition or neutralization of at least any abrasive particles not simply displaced by the rinsing fluid.

The rinsing fluid used to dissolve the abrasive particles can be water or a combination of water and organic solvents. Useful organic solvents include glycol ethers such as the line of glycol ethers commercially available from Union Carbide under the trade name of CARBITOL® and from Dow Chemical under the trade name DOWANOL®; and alcohols such as ethanol, methanol, and butanol. Sometimes acids or amines particularly those in aqueous solutions may also be used to decompose or neutralize the abrasive particles. Useful acids include inorganic and organic acids that are compatible with the coating that will be subsequently circulated in the fluid delivery system, such as, formic acid, acetic acid, lactic acid, phosphoric acid, sulfamic acid, glycolic acid, and carbonic acid. For instance, acids are useful to dissolve, decompose or neutralize abrasive particles such as sodium bicarbonate, potassium fluorotitanate, calcium citrate, calcium borate, zinc borate, calcium succinate, calcium pyrophosphate, starch, and calcium phosphate. Normally, the pH of the rinsing fluid for dissolving the abrasive particles will be below 7 when acid solutions are used. Amines are useful to dissolve, decompose or neutralize boric acid. Normally, the pH of the rinsing fluid will be above 7 when amines are used. Examples of suitable amines include alkanolamines, dialkanolamines, trialkanolamines, alkylalkanolamines, arylalkanolamines, and arylalkylalkanolamines containing from 2 to 18 carbon atoms in the alkanol, alkyl, and aryl chains. Specific examples include ethanolamine, N-methylethanolamine, diethanolamine, N-phenylethanolamine, N,N-dimethylethanolamine, N-methyldiethanolamine and triethanolamine. A preferred amine is triethanolamine.

The abrasive cleaner and/or abrasive-containing cleaning composition has typical concentrations of the solubilizable abrasive particles in the range from about 1 to 20 percent by weight of the cleaner or composition. When cleaning typical paint fluid delivery systems, the concentration of the abrasive particles in the cleaner or abrasive-containing cleaning compositions of the present invention may range from 5 to 20 percent by weight, preferably about 6 to 10 percent by weight; however, when potassium fluorotitanate is used, the concentrations may range from about 1 to 10 percent by weight, preferably about 1 to 3 percent by weight. In cleaning electrocoat systems, concentrations of abrasive particles may range from 9 to 20 percent by weight, preferably about 12 to 15 percent by weight; however, when potassium fluorotitanate is used, from about 1 to 10 percent by weight, preferably from about 1 to 3 percent by weight. All of the aforementioned weight percentages are based on the total of all components for either the abrasive cleaner or abrasive-containing cleaning compositions.

The abrasive cleaner and/or abrasive-containing cleaning composition of this invention may also contain surfactants. Anionic, cationic and nonionic surfactants are suitable for use in these cleaner compositions, with the selection of the type of surfactant based on the deposited material that is to be removed from the fluid delivery system. Surfactants are generally characterized by the ionic charge carried by the compound. Anionic surfactants such as carboxylates, sulfonates, sulfates, and protein hydrolysates carry a negative charge. Some nonlimiting examples of anionic surfactants include the dimethylethanolamine salt of dodecylbenzenesulfonic acid, sodium dioctylsulfosuccinate, sodium dodecyl benzene sulfonate, and salts of ethoxylated nonylphenol sulfate. Cationic surfactants such as mono-, di-, and polyamines, imidazolines, and quaternary ammonium salts carry a positive charge. Nonionic surfactants such as those derived from carboxylic acids, amides, esters, acetylenic polyols and polyalkylene oxides carry no ionic charge. Some nonlimiting examples of nonionic surfactants include 4,7-dimethyl-5-decyn-4,7-diol, 2,4,7,9-tetramethyl-5-decyn4,7-diol which are commercially available from Air Products and Chemicals under the tradename SURFYNOL®. Typically, surfactants are present in the abrasive cleaner and/or abrasive-containing cleaning composition and can also be present in the pretreatment fluid in an amount from about 0.1 to 5 percent, preferably from about 0.5 to 3 percent by weight of the composition.

The abrasive cleaner and/or abrasive-containing cleaning compositions of the present invention can also contain acids, including organic acids, or alkali materials to aid in the removal of the unwanted deposited materials from the inner surfaces of a fluid delivery system. Typically, acids or alkali materials may be present in these cleaner compositions up to about 20 percent by weight. Useful acids may include formic acid, acetic acid, lactic acid, phosphoric acid, sulfamic acid, carbonic acid, methanoic acid, and hydroxyacetic acid. Some useful alkali materials include sodium hydroxide, potassium hydroxide, and amines such as those mentioned above.

The abrasive cleaner and/or abrasive-containing cleaning compositions and rinsing fluid optionally with the pretreatment fluid can be in an abrasive cleaning kit for cleaning deposits or unwanted materials or deposits from fluid delivery systems in accordance with the present invention. The kit has containers of: i) (A) the abrasive cleaner composition and (B) rinsing fluid, or ii) (A), (B) and (C) pretreatment fluid. These various compositions are those discussed above. The size of a kit may vary depending on the size of the fluid delivery system to be cleaned. A kit can contain from 1 gallon of each material, (A), (B), and/or (C), to 2000 gallons of each, i.e. (4 to 7600 liters). A kit may contain more than one container of any one material. The containers generally have sufficient volume so that the (A), (B), and/or (C) cleaners and fluids can be added to a fluid delivery system in the appropriate order of abrasive cleaner and rinsing fluid or pretreatment fluid, abrasive cleaner and rinsing fluid. The containers can be adaptable to have appropriate connection devices suitable for the appropriate addition of the proper material to the fluid delivery system.

The invention will be further described by reference to the following examples which are presented for the purpose of illustration only and are not intended to limit the scope of the invention.

EXAMPLES

Examples I to IV show the cleaning of electrocoat system ultrafilter membranes with the method and compositions of the present invention. Examples V to VIII show the cleaning of paint fluid delivery tubing using the method and compositions of the present invention. Examples V and VI show the removal of deposited waterborne coatings from the inside of paint fluid lines. Encrusted waterborne coatings have proven to be extremely difficult to remove from paint fluid lines. Examples VII and VIII show the removal of deposited solventborne coatings from the inside of paint fluid lines. It should be noted that for Example VII, an acid such as mentioned above, and for Example VIII, an amine such as mentioned above, could be added to the rinsing fluid to decompose the abrasive particles. This addition would be useful in an automobile plant paint system to remove compacted abrasive that may collect in elbow or valve areas of the paint fluid delivery system. Example IX shows the cleaning of an electrocoat system spiral wound ultrafilter module with the method and compositions of the present invention.

Example I (Cleaning of Electrocoat System Ultrafilter Membranes according to the Method of this Invention)

A pretreatment fluid composition was prepared by adding the following ingredients together in the order listed with mild stirring:

| Ingredients | Parts by weight |
|---|---|
| Butyl CELLOSOLVE[1] | 10 |
| Lactic Acid[2] | 5 |
| Surfactant[3] | 12 |
| Nitric Acid[4] | 1 |
| Deionized Water | 72 |

This pretreatment fluid composition was used to clean fouled tubular ultrafilter membranes which had been fouled with a cationic electrodeposition paint such as the type generally described in U.S. Pat. No. 4,933,056. The ultrafilter membranes were contained in a plastic tube that is about 3 meters long with an inner diameter of 3.7 cm. Seven individual tubular ultrafilter membranes with an outer diameter of 1.3 cm were arranged inside the plastic tube. This ultrafilter equipment is commercially available from KOCH Membrane Systems Inc. and is called the UltraCor-7 plus™ Module, Model No. 10 HFM-183 UEP.

The fouled ultrafilter module was mounted to a structural support rack and connected to a recirculation system comprising a day tank, or holding tank, which contained the pretreatment fluid and a pump which moved the pretreatment fluid from the day tank into the inlet end of the ultrafilter tube. The pretreatment fluid was recirculated across the surface of the membrane and returned to the day tank. In this fashion the pretreatment fluid may be recirculated through the interior of the individual ultrafilter membrane tubes. Multiple ultrafilter modules may be mounted and connected in series. A series of tubes that had failed a conventional cleaning were processed by first recirculating the pretreatment fluid described above for a period of 8 hours. The pretreatment was operated at an initial temperature of 74° F. (23° C.) at a pressure of (inlet/outlet) 55/2 psi (379/13.8 kPa).

The pretreatment fluid was drained from the system and the tubes were rinsed with deionized (DI) water. DI flux rates were measured at this point Units are gallons per square foot per day (GFD).

| Tube | Flux |
|---|---|
| Tube #1 | 312.9 GFD (12,748 l/m$^2$/day) |
| Tube #2 | 219.0 GFD (8923 l/m$^2$/day) |
| Tube #3 | 354.6 GFD (14,447 l/m$^2$/day) |

Fifteen weight percent of sodium bicarbonate particulates were introduced into the recirculation system with water to form an abrasive cleaning composition and circulated using the pressures of normal usage in paint delivery. One hour later circulation of the abrasive cleaner was discontinued and drained from the filter tubes. Deionized water flux rates were then remeasured to evaluate the progress of the abrasive cleaning.

| Flux | % change in Flux** |
|---|---|
| Tube #1 375.9 GFD* (15,315 l/m$^2$/day) | +20% |
| Tube #2 278.7 GFD (11,355 l/m$^2$/day) | +27% |
| Tube #3 334.5 GFD (13,628 l/m$^2$/day) | −6% |

The circulation of the abrasive cleaner was then restarted and continued for an additional eight hours. The system was again rinsed with DI water, followed by a treatment of 1% Lactic Acid, 88% active, to dissolve any residual sodium bicarbonate. The ultrafilter membranes were then cut open and visually inspected. The membranes were found to be nearly 100% clean.

Example II (Cleaning of Electrocoat System Ultrafilter Membranes According to the Method of this Invention)

A pretreatment fluid composition was prepared by adding the following ingredients together with mild stirring.

| Ingredients | Parts by Weight |
|---|---|
| Deionized Water | 92.5 |
| Butyl CARBITOL[1] | 2.5 |
| Butyl lactate[2] | 2.5 |
| N-octyl-2-Pyrrolidinone[3] | 2.5 |

This pretreatment fluid was used to immersion clean individual ultrafilter membrane tubes of the UltraCor 7 plus™ Module. These ultrafilters were fouled with the same cathodic electrodeposition paint referenced in Example I. Both ends of the plastic Module housing were removed with a hacksaw so that any one of the seven individual ultrafilter membrane tubes contained inside could be carefully removed and cleaned on the following ultrafilter membrane cleaning test apparatus. A 33-inch (84 cm) length of membrane tube was removed and placed inside a stationary plastic pipe of the same length. Hoses were fastened to both ends of the filter tube by means of a metal fitting that slides snugly inside the ends of the membrane tube. A pump was used to pump cleaning solution from a day tank through the interior of the membrane tube under pressure. The hose fittings and pipe ends were enclosed with a flexible sleeve that extends over the ends of the stationary pipe to the hose such that the fittings and membrane were totally sealed inside the pipe. The permeate that passed through the wall of the membrane itself was drained passively through a hole in the stationary pipe back to a day tank containing the cleaning solution. In this fashion a single length of tubular ultrafilter membrane was experimentally cleaned by recirculating a cleaning solution through the membrane tube. The degree or residue removal was estimated by removing the tube from the apparatus and looking through one end.

An ultrafilter membrane tube was soaked for four hours in the pretreatment fluid described above. Five gallons (9 liters) of an abrasive cleaning composition (abrasive cleaner) was prepared by adding 0.2% by weight each of Butyl CARBITOL, Butyl Lactate and N-octyl-2-pyrolidinone to deionized water. Three liters of boric acid particles were added to the 5 gallons (9 liters) of abrasive cleaner with continuous agitation. The abrasive cleaner composition was recirculated through the filter tube for three hours. At the end of each hour, the tube was removed and examined for surface area cleaned. After the first hour of recirculation the membrane tube was 25% clean. At the end of the third hour, the membrane tube was still 25% clean. The system was rinsed thoroughly with DI water. The pH of the rinsing fluid was adjusted to 6 with triethanolamine to dissolve any residual boric acid particles.

Example III (Cleaning of Electrocoat System Ultrafilter Membranes According to the Method of this Invention.)

Individual ultrafilter membrane tubes from the UltraCor plus™ Module used in Example II were immersed for 24 hours in the pretreatment fluid described in Example II. A first tube was thereafter processed under the same conditions as Example II. Three liters of boric acid particles were added to the pretreatment fluid as recirculation was started. The membrane tube was examined after 1 hour of recirculation and found to be 100% devoid of observable paint. A second tube was processed as the first and found to be 95% clean after the first hour of abrasion.

The results of this example when compared to the results of Example II show that additional soak time with the pretreatment fluid aides in the softening of the adhered paint; thereby, enabling the abrasive cleaner to be more effective.

Example II used a four-hour soak and achieved a cleaning of 25% after three hours of abrasive cleaner circulation, while Example III used a 24 hour soak and achieved a cleaning of at least 95% after only one hour of abrasive cleaner circulation.

Example IV (Cleaning of Electrocoat System Ultrafilter Membranes According to the Method of this Invention.)

An ultrafilter module was filled with the pretreatment fluid of Example II and soaked for 24 hours. Individual ultrafilter membrane tubes were removed and processed under conditions similar to Example II, but with a different abrasive. Two liters of potassium titanium fluoride powder were added to the pretreatment fluid to form an abrasive-containing cleaning composition, and the abrasive containing cleaner was then recirculated. The membrane tube was examined after two hours of recirculation. The first two-thirds of the inlet side of the tube was 75% clean. The remaining one-third was 15% clean. This was a significant improvement over nonabrasive cleaning.

Example V (Cleaning of Automotive Waterborne Base Coat from Metal Paint Lines According to the Method of this Invention)

A pretreatment fluid composition for automotive base coat paint was prepared by adding the following ingredients together in the order listed with mixing.

| Ingredients | Parts by weight |
|---|---|
| Water | 43.6 |
| Butyl CARBITOL[1] | 43.0 |
| Aliphatic dibasic acid esters[2] | 12.0 |
| Sodium N-Methyl Oil Acid Taurate[3] | 0.6 |
| 2-Amino-2-Methyl-1-Propanol, 95%[4] | 0.6 |

Thirteen gallons (49 liters) of the above pretreatment fluid was charged into a recirculation tank fitted with a section of dirty paint line from an automotive assembly plant. The paint line contained deposits of red metallic waterborne paint of a composition typical of waterborne formulations, which included acrylic latex polymer, melamine resin, mica, iron oxide and other red pigments. This paint line segment represented a worst case for cleaning as the paint build-up was excessive, old, and included recently coagulated paint. This coagulated paint has proved difficult to remove in past field cleanings.

The stainless steel paint line test segments were approximately 8 inches (20 cm) long by 1.25 inches (3.2 cm) in diameter, interior surface area equaling 31.4 square inches (203 $cm^2$). Fluid flow through the system was 7.93 gallons (30 liters) per minute at 5 psi (34.5 kPa). The operating temperature range was from 80° F. to 120° F. (27° C. to 49° C.). The pH of the pretreatment fluid was measured at 10.0. The paint line segment was inspected prior to the pretreatment fluid circulation to establish the starting condition of the paint build-up. The pretreatment fluid was circulated for nine hours total with two visual inspections during that time. After nine hours circulation, the paint build-up showed softening but not signs of removal. The pretreatment fluid was then charged with 9.2% by weight of granular sodium bicarbonate particles to form an abrasive-containing cleaning composition. The quantity used assured the saturation of the abrasive-containing cleaning composition with sodium bicarbonate particles, thus having solid non-solubilized sodium bicarbonate particles available to act as an abrasive. This abrasive was chosen due to its compatibility with the pretreatment fluid and its ability to be decomposed either with a mild acid solution or by successive dilutions in the water. Testing was resumed after the circulation tank was fitted with an agitator to disperse and suspend the sodium bicarbonate solids in solution.

The test was ended after 13.5 hours of circulation with the sodium bicarbonate abrasive. Six visual inspections of the pipe interior were made during that time. Approximately 35 to 40% of the existing paint build-up was removed to bare metal. This is a significant improvement in paint removal compared to circulation of the pretreatment fluid alone.

Example VI (Cleaning of Automotive Waterborne Base Coat from Metal Paint Lines According to the Method of this Invention.)

A pretreatment fluid composition was prepared by adding the following ingredients together in the order listed with mixing.

| Ingredients | Parts by weight |
|---|---|
| Water | 28.4 |
| Butyl CARBITOL[1] | 41.5 |
| Aliphatic dibasic acid esters[2] | 12.0 |
| N-Methyl-2-Pyrrolidone | 8.0 |
| Hydroxyacetic acid | 5.5 |

-continued

| Ingredients | Parts by weight |
|---|---|
| Methanoic acid | 4.5 |
| Sodium N-Methyl Oil Acid Taurate[3] | 0.1 |

Thirteen gallons (49 liters) of the above pretreatment fluid was charged to a recirculation tank fitted with a section of dirty paint line from an automobile assembly plant. The paint line contained deposits of red metallic waterborne paint with a composition typical of waterborne formulations, similar to that of Example V above. This paint line segment represented a worst case for cleaning as the paint build-up was excessive, old, and included recently coagulated waterborne paint. This coagulated paint has proven difficult to remove in past field cleanings.

Dimensions of the stainless steel paint line segment, fluid flow, and operating temperatures were as described in Example V. The pH of the pretreatment fluid was measured at 2.5. The paint line segment was inspected prior to abrasive cleaner circulation to establish the starting condition of the paint build-up. The pretreatment solution was circulated for 19.25 hours total with seven visual inspections during that time. After 19.25 hours, the paint build-up showed softening but not signs of removal.

The pretreatment fluid was then charged with 9.2% by weight of granular boric acid particles to form an abrasive-containing cleaning composition. The quantity used assured the saturation of the abrasive-containing cleaning composition with boric acid particles, thus having solid non-solubilized boric acid particles available to act as an abrasive. This abrasive was chosen due to its compatibility with the pretreatment fluid and its ability to be decomposed either with a mild basic solution or by successive dilutions with water. Testing was resumed after the circulation tank was fitted with an agitator to disperse and suspend the boric acid solids in solution. The test was ended after 16.75 hours of circulation with the boric acid abrasive. Six visual inspections of the pipe interior were made during that time. Approximately 10% of the existing paint build-up was removed, leaving a light red pigment residue. This shows improvement in paint removal compared to circulation of the pretreatment fluid alone.

Example VII (Cleaning of Automotive Solventborne Base Coat from Metal Paint Lines According to the Method of this Invention)

A pretreatment fluid composition was prepared by adding the following ingredients together and mixing.

| Ingredients | Parts by Weight |
|---|---|
| SOLVESSO 150[1] | 30.0 |
| SOLVESSO 100[2] | 30.0 |
| n-Butyl acetate | 13.5 |
| n-Butyl alcohol | 1.5 |
| Butyl CARBITOL | 15.0 |
| Aliphatic dibasic acid esters | 10.0 |

Two gallons (7.6 liters) of the above pretreatment fluid was charged into a stainless steel recirculation tank fitted with a magnetic-drive centrifugal pump and approximately 5 ft. (1.5 m) of ⅜ inch (9.2 mm) internal diameter (i.d.) TYGON tubing, allowing for the installation of ⅜ inch (9.2 mm) i.d. paint lines, approximately 2 ft. (0.6 m) long, into the recirculation loop for testing. The pump flow was measured at approximately 2 gallons (7.6 liters) per minute. The pretreatment fluid was circulated through the pump, tubing, and paint line segments removed from an automobile assembly plant. The paint line segments were contaminated with uncured solventborne topcoat with a composition typical of solventborne automotive topcoats (acrylic polymers, melamine resin, and various pigments including aluminum flake ). The paint lines represented a typical case of automotive paint line contamination.

Operating temperature of the pretreatment was 80° F. (27° C). The paint line segments were visually inspected prior to pretreatment fluid circulation to establish the starting condition of the paint build-up. The pretreatment fluid was circulated for 1.5 hours at which time the lines were again visually inspected. Several of the paint line segments were totally cleaned by the circulation of the pretreatment fluid, and were removed from the test. The remaining paint line segments were purged with air to evaporate a traces of the pretreatment fluid, then set aside for further cleaning with the abrasive-containing cleaner.

The pretreatment fluid was then charged with 2.3 percent by weight of sodium bicarbonate and the recirculation tank was fitted with a stirrer to keep the abrasive sodium bicarbonate particles suspended in the solution. Six of the partially cleaned paint lines from the pretreatment step were then individually installed in the recirculation loop described above and tested for five-minute intervals. The paint line segments were visually examined after each five-minute circulation interval. Circulating the abrasive-containing cleaning composition through each of the six paint line segments cleaned 100 percent of the remaining deposited paint in each segment within 10 minutes of circulation time. This represents an improvement in both cleaning effectiveness and cleaning time.

Then the abrasive-containing cleaner material was drained from the recirculating system and the system was then charged with a rinsing fluid made from the following ingredients to completely remove all the sodium bicarbonate particles. The fluid was circulated for 30 minutes and then drained. The holding tank and lines were then inspected for the presence of the abrasive sodium bicarbonate particles. No particles were found indicating that any remaining abrasive particles were decomposed and removed by the rinsing fluid.

| Ingredients | Parts by weight |
|---|---|
| Butyl CARBITOL | 33.3 |
| Water | 23.4 |
| n-Butanol | 43.3 |

Example VIII (Cleaning of Automotive Solventborne Base Coat from Metal Paint Lines According to the Method of this Invention)

Five contaminated paint line segments were cleaned using the same pretreatment fluid and process of Example VII, except that the solubilizable abrasive used was boric acid. The five paint line segments were contaminated with the same solventborne automotive topcoat as in Example VII. Circulating the abrasive-containing cleaner material through each of the five paint line segments cleaned 100 percent of the remaining deposited paint in each segment within ten minutes of circulation time. This represented an improvement in both cleaning effectiveness and cleaning time. The system was drained and rinsed using the same technique and rinsing fluid as in Example VII. Results were identical, with no abrasive particles remaining in the circulating system.

Example IX (Cleaning of Electrocoat System Ultrafilter Membranes According to the Method of this Invention)

A two-inch diameter by 15-inch long Spiral Wound ultrafilter module was filled with the pretreatment fluid of Example II and soaked for 14 hours. This bench top spiral unit is supplied by KOCH MEMBRANE SYSTEMS, INC. Wilmington, Mass. (Model S2HMF183 VYV 6003). The ultrafilter module is configured such that a fluid may be pumped in one end of the tube containing the ultrafilter and exit at the opposite end and returned to the reservoir from which it was pumped. As the fluid moves through the ultrafilter, permeate is removed. A Spiral-Wound ultrafilter differs from the tubular membrane ultrafilter in that a sheet of "assembled membrane" is rolled or wound up and inserted into a tube. To elaborate, permeate is collected by placing a sheet of permeate collection material between two sheets of membrane. Membrane to membrane contact is avoided by using a sheet of feed channel spacer. After this assembly is wound up on a permeate pipe containing collection holes, it is inserted in a snug fitting tube. Paint is pumped into one end of the tube and feeds across the channel spacer. Fluid that is able to cross the membrane follows the permeate collection material to the center of the module and is collected inside the permeate pipe. Once inside the permeate pipe, the permeate exits the module via an extension of the permeate pipe through the enclosed end of the tube. The fluid that does not cross the membranes on either side of the channel spacer exits from a suitable opening at the other end of tube and is returned to its source.

When the soak period for the pretreatment fluid was completed, the ultrafilter was rinsed three times with DI water and a water flux determination was made with DI water. The measured flux was 194.6 gfd (gallons/square foot/day) (7929 $lm^2$/day).

At this point the pretreatment fluid was put back on line and 4% by weight of zinc borate particles, commercially available from U.S. Borax Inc., Valencia, Calif. as Borogard ZB, was added to the pretreatment fluid and circulated through the filter for 45 minutes. The abrasive particles were rinsed from the system with two rinses of DI water. In order to ensure that all the abrasive was removed from the ultrafilter system, a 5% by volume solution of lactic acid in water was circulated through the ultra filter module for 10 minutes to dissolve any residual zinc borate particles. The module was rinsed with DI water and another water flux determination made. The post-abrasive water flux was 232 gfd (9452 $l/m^2$/day).

The cleaning with the abrasive cleaner resulted in a 19% increase in gfd over pretreatment fluid cleaning alone. A direct examination of the filter was made by opening the filter and unwinding it to expose the membrane surface. Its surface area was found to be over 98% free of visually detectable paint.

What is claimed is:

1. A method of cleaning unwanted materials from interior surfaces of fluid delivery systems comprising the steps of:(a) contacting the interior surfaces of the fluid delivery system with a pretreatment fluid composition comprising water and a liquid organic solvent capable of softening the material that is to be cleaned from the internal surfaces of the delivery system, for a time sufficient to soften said material; (b) passing through said system at least once an abrasive cleaner composition comprising a liquid carrier containing solubilizable abrasive particles, at least some of which are in non-solubilized form, effective to abrade the material to be removed from the interior surfaces; and (c) rinsing said system with at least one fluid effective to (i) displace said carrier and (ii) remove said abrasive particles at least partially by dissolution, decomposition or neutralization.

2. The method of claim 1 wherein in passing the abrasive cleaner composition through the system, the liquid carrier comprises at least one material chosen from the group consisting of water, organic solvents, and mixtures thereof.

3. The method of claim 1 wherein in passing the abrasive cleaner composition through the system, the abrasive cleaner additionally comprises at least one material chosen from the group consisting of surfactants, acids, alkali materials and mixtures thereof.

4. The method of claim 1 wherein in passing the abrasive cleaner composition through the system, the abrasive particles are selected from the group consisting of sodium bicarbonate, boric acid, potassium fluorotitanate, calcium citrate, calcium borate, zinc borate, calcium succinate, calcium pyrophosphate, calcium phosphate, and starch.

5. The method of claim 1 wherein in passing the abrasive cleaner composition through the system, the abrasive particles are present in the cleaner composition in an amount ranging from about 1 to 20 percent by weight.

6. The method of claim 1 wherein the step (b) of passing the abrasive cleaner composition through the fluid delivery system at least once includes continuously recirculating the abrasive cleaner composition through the fluid delivery system.

7. The method of claim 1 wherein in contacting the interior surfaces of the fluid delivery system with a pretreatment fluid, the liquid of the pretreatment fluid additionally comprises at least one material chosen from the group consisting of surfactants, acids, alkali materials, and mixtures thereof.

8. The method of claim 1 wherein in contacting the interior surfaces of the fluid delivery system with a pretreatment fluid, the liquid of the fluid composition contains N-alkyl-pyrrolidone wherein the alkyl group contains from 1 to 12 carbon atoms.

9. The method of claim 1 wherein in rinsing, the rinsing fluid comprises water and at least one material chosen from the group consisting of organic solvents, acids, amines, and mixtures thereof effective to remove by dissolution remaining abrasive particles.

10. The method of claim 1 wherein in rinsing, the pH of the rinsing fluid is from about 1 to 7.

11. The method of claim 1 wherein in rinsing, the pH of the rinsing fluid is from about 7 to 14 when the abrasive particles are boric acid.

12. The method of claim 1 wherein the fluid delivery system is a paint fluid delivery system.

13. The method of claim 12 wherein the fluid delivery system is an electrocoat fluid delivery system having ultrafilter membranes.

14. The method of claim 1 wherein the fluid delivery system is a dairy product fluid delivery system.

15. A method of cleaning unwanted materials from interior surfaces of fluid delivery systems comprising the steps of (a) contacting the interior surfaces of the fluid delivery system with a pretreatment fluid composition comprising a water and a liquid organic solvent capable of softening the unwanted material that is to be cleaned from the internal surfaces of the delivery system, for a time sufficient to soften said material; (b) passing through said system at least once an abrasive cleaner composition formed by adding to the pretreatment fluid solubilizable abrasive particles, at least some of which are in non-solubilized form, effective to abrade the material to be removed from the interior surfaces; and (c) rinsing said system with at least one fluid effective to (i) displace said carrier and (ii) remove said abrasive particles at least partially by dissolution.

16. An abrasive cleaning kit capable of cleaning unwanted materials from interior surfaces of fluid delivery systems comprising:

(A) a pretreatment fluid comprising water and a liquid organic solvent capable of softening the unwanted material that is to be cleaned from the interior surfaces of the fluid delivery system;

(B) an abrasive cleaner composition comprising a liquid carrier containing solubilizable, but having non-solubilized, abrasive particles effective to abrade the unwanted material; and (C) at least one rinsing fluid effective to (i) displace said carrier and (ii) remove said abrasive particles at least partially by dissolution, comprising water and at least one material chosen from the group consisting of organic solvents, acids, amines, and mixtures thereof effective for such dissolution.

17. The abrasive cleaning kit of claim 16 wherein the liquid carrier of (A) comprises at least one material chosen from the group consisting of water, organic solvents, and mixtures thereof.

18. The abrasive cleaning kit of claim 16 wherein the abrasive cleaner of (A) additionally comprises at least one material selected from the group consisting of surfactants, acids, alkali materials, and mixtures thereof.

19. The abrasive cleaning kit of claim 16 wherein the solubilizable abrasive particles of (A) are chosen from the group consisting of sodium bicarbonate, boric acid, potassium fluorotitanate, calcium citrate, calcium borate, zinc borate, calcium succinate, calcium pyrophosphate, and calcium phosphate.

20. The abrasive cleaning kit of claim 16 wherein the solubilizable abrasive particles are present in the abrasive cleaner composition of (A) in an amount ranging from about 1 to 20 percent by weight.

21. The abrasive cleaning kit of claim 16 wherein the liquid of the pretreatment fluid additionally comprises at least one material chosen from the group consisting of surfactants, acids, alkali materials, and mixtures thereof.

22. The abrasive cleaning kit of claim 16 wherein the liquid of the pretreatment fluid contains N-alkyl-pyrrolidone wherein the alkyl group contains from 1 to 12 carbon atoms.

23. The abrasive cleaning kit of claim 16 wherein the pH of the rinsing fluid of (C) is from about 1 to 7.

24. The abrasive cleaning kit of claim 16 wherein the pH of the rinsing fluid of (C) is from about 7 to 14 when the abrasive particles of (B) are boric acid.

* * * * *